US006125682A

United States Patent [19]

Rzasa et al.

[11] Patent Number: 6,125,682

[45] Date of Patent: Oct. 3, 2000

[54] HYDRAULIC TOOL ALIGNMENT GUARD

[75] Inventors: Michael Rzasa, Nashua; Keith Mello, Manchester, both of N.H.

[73] Assignee: Framatome Connectors USA, Inc., Fairfield, Conn.

[21] Appl. No.: 09/013,506

[22] Filed: Jan. 26, 1998

[51] Int. Cl.[7] ..... H01R 43/042

[52] U.S. Cl. ..... 72/412; 72/461; 29/751

[58] Field of Search ..... 72/409.13, 409.14, 72/409.01, 412, 416, 461; 29/751, 237

[56] References Cited

U.S. PATENT DOCUMENTS

| | | | |
|---|---|---|---|
| 166,134 | 7/1875 | Norton . | |
| 471,129 | 3/1892 | Loveland et al. . | |
| 601,230 | 3/1898 | Billing et al. . | |
| 1,001,054 | 8/1911 | Lawrence . | |
| 1,652,835 | 12/1927 | Peirce, Jr. . | |
| 1,823,158 | 9/1931 | Mogford et al. . | |
| 2,035,686 | 3/1936 | Briegel | 153/2 |
| 2,291,803 | 8/1942 | Grotnes | 78/15 |
| 2,382,359 | 8/1945 | Weightman | 78/15 |
| 3,332,272 | 7/1967 | Tonchen | 72/410 |
| 3,481,373 | 12/1969 | Blagojevich . | |
| 3,487,524 | 1/1970 | Filia | 29/203 |
| 3,523,351 | 8/1970 | Filia | 29/203 |
| 3,571,890 | 3/1971 | Brehm | 72/409.14 |
| 3,577,622 | 5/1971 | Shaffer | 29/200 |
| 3,710,610 | 1/1973 | McCaughey | 72/409.06 |
| 3,737,975 | 6/1973 | McKinnon, Jr. | 29/421 |
| 3,783,487 | 1/1974 | May | 29/203 D |
| 3,792,603 | 2/1974 | Orain | 72/402 |
| 3,823,462 | 7/1974 | Kanda | 29/268 |
| 3,872,578 | 3/1975 | Ullom | 29/525 |
| 3,916,517 | 11/1975 | Luongo | 29/628 |
| 3,931,726 | 1/1976 | Grubb | 72/430 |
| 4,754,636 | 7/1988 | Kautz | 72/409.14 |
| 4,829,654 | 5/1989 | Hangebrauck | 29/508 |
| 5,007,280 | 4/1991 | Quinn et al. | 72/402 |
| 5,377,400 | 1/1995 | Homm | 72/461 |
| 5,775,158 | 7/1998 | Hensley | 72/461 |

FOREIGN PATENT DOCUMENTS

| | | | |
|---|---|---|---|
| 668285 | 8/1963 | Canada | 72/409.14 |
| 713028 | 10/1931 | France . | |
| 1405373 | 9/1975 | United Kingdom . | |

*Primary Examiner*—Daniel C. Crane
*Attorney, Agent, or Firm*—Perman & Green, LLP

[57] ABSTRACT

A hydraulic compression tool comprises a frame and a die movably connected to the frame with a hydraulic drive system. An alignment guard is connected to the frame, and the alignment guard extends along a side of the die and has a receiving area to a receive a workpiece therein such that the workpiece can be received in the receiving area and make contact with the alignment guard such that the alignment guard aligns the workpiece relative to the path of a die for aligning contact of the die against the workpiece as the die is moved toward the workpiece.

19 Claims, 6 Drawing Sheets

HYDRAULIC TOOL ALIGNMENT GUARD

BACKGROUND OF THE INVENTION

1. Field of the Invention

The present invention relates to an improvement in a crimping tool, and relates more particularly to a tool assembly for use with a work piece, such as a rail onto which is formed a dimple, whereby a guard is provided which employs an improved sheet metal piece which prevents hands, digits or foreign objects from entering the area of the tool impacted on the work piece by actuation, thus preventing bodily injury and/or damage to the tool.

2. Background of the Art

U.S. Pat. No. 5,084,963 issued to Murray et al. on Feb. 4, 1992 discloses a preconnection deforming die and method of connecting a grounding rod with an electrical cable. However, the device disclosed in this patent is concerned with a deformable metal connector which is adapted to configure around a grounding rod. This type of connector is usually placed circumferentially about the rod and compressed or crimped by a tool such a hydraulic compression tool to secure the connector onto the rod.

The present invention however is concerned with performing a work operation on a work piece. Such an operation can be in the form of cutting, or dimpling of a rail surface for an electrical connection to be made thereto. Usually following such a dimpling process an electrical connection is mechanically connected to the rail surface via a bolt clamp which has teeth that bite down on the rail top and bottom surface. In the past, it has been found that while cutting a cable or creating a dimpled surface on the rail foot, unwanted objects, such as debris or the like, may become interposed between the die and the surface to be worked on and damage the tool. More important however, it is desirable to prevent hands, digits or feet from entering the tool impacting area which is driven by the hydraulic ram under considerable force and to thus prevent any bodily injury.

Accordingly, it is an object of the present invention to provide a guard for a compression tool which allows non-interrupted functioning of the compression tool while nevertheless providing safe operation for the user.

Still a further object of the invention is to provide a hydraulic compression tool the aforementioned type wherein the guard provides alignment capabilities as well as providing a safety function for the tool.

Yet still a further object of the invention is to provide a compression tool guard which is capable of being readily fabricated inexpensively and with high durability.

Still a further object of the invention is to provide a guard of the aforementioned type wherein the guard is capable of being readily assembly to existing structure in a compression tool.

Further objects and advantages of the invention will become apparent from the following description in the appended claims.

SUMMARY OF THE INVENTION

The invention resides in a hydraulic compression tool which comprises a frame and a die movably connected to the frame with a hydraulic drive system. An alignment guard is connected to the frame, and the alignment guard extends along a side of the die and has a receiving area to a receive a workpiece therein such that the workpiece can be received in the receiving area and make contact with the alignment guard such that the alignment guard aligns the workpiece relative to the path of a die for aligning contact of the die against the workpiece as the die is moved toward the workpiece.

Ideally, the tool is comprised of a fixed die disposed oppositely of the movable die and the alignment guard is attached to one of the fixed die and moving die and has a generally U-shaped construction having lateral side walls and a transverse portion.

In one embodiment, the side walls are plate elements attached to lateral sides of the fixed die. and the plate elements are the lateral side walls of the U-shaped body.

In another embodiment, the guard is defined by integrally formed side walls and a connecting transverse portion and the side walls and the transverse portion each being connected to one another through the intermediary of stiffening ribs.

Desirably, the generally U-shaped body including has at least two openings formed thereon disposed in alignment with threaded openings in one of the fixed and movable die.

In one embodiment, the side walls defining the receiving area are defined by an angled side edge connecting to a vertically extending side edge and an edge disposed perpendicularly thereto for receiving an angled flange therein.

More specifically, the guard is adapted for working with a hand held compression tool acting on surface of a workpiece and comprises a base defined by a substantially transversely extending member. Two parallel spaced sidewall members are provided each extending generally perpendicularly to and secured to the base, the sidewall members being spaced a distance apart to accommodate the width of a tool therein.

The sidewall members include means for connecting same to the base and including a cutout sized to accommodate the profile of a workpiece to be worked on by the tool acting in a direction perpendicularly to the workpiece surface to be acted on.

Ideally, the sidewalls at the side edges thereof have one end and another end to define the overall length thereof and the base being located closer to the one end than to the another end.

DETAILED DESCRIPTION OF THE PREFERRED EMBODIMENT

Figure 1:
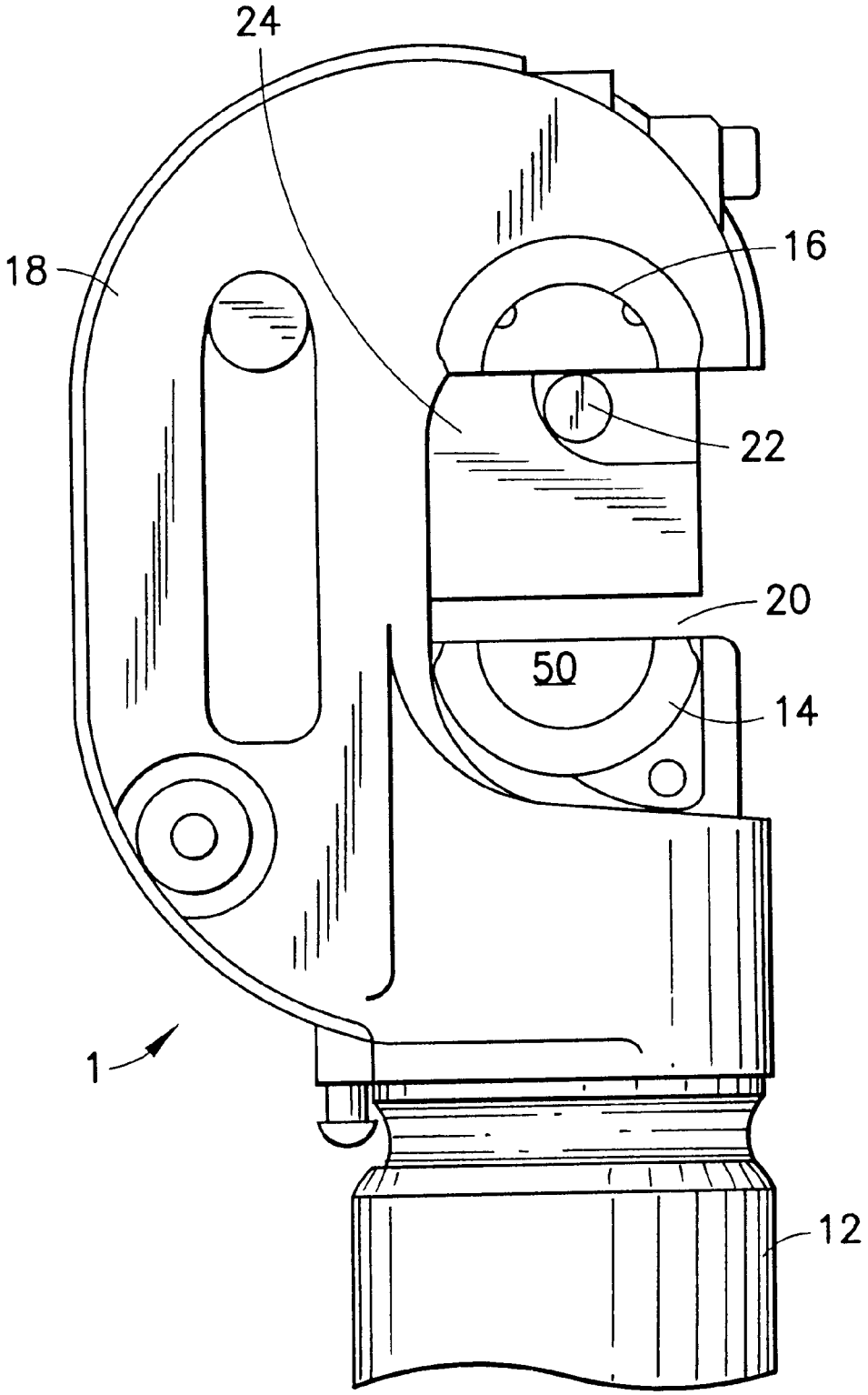
FIG. 1 is a partially-fragmentary side elevation view of a compression cutting tool with a guard mounted thereon.

Referring now to FIG. 1, there is shown a hydraulically actuated tool 10 which is known. The tool may be used for various purposes depending on the type of die which is substituted within the jaws of the tool. However, for purposes of the present invention disclosure, two types of work processes will be discussed, namely, a cutting tool and a dimpling tool application which can be readily substituted within the tool 10. It is noted that when reference is made to the tool used in the cutting mode, no prime numbers will be used with reference to the tool, whereas when discussing the tool in its dimpling mode, prime indicia (') will be used. Also, the same numerals used in different embodiments reflect corresponding similar or identical elements between the different embodiments.

Figure 10:
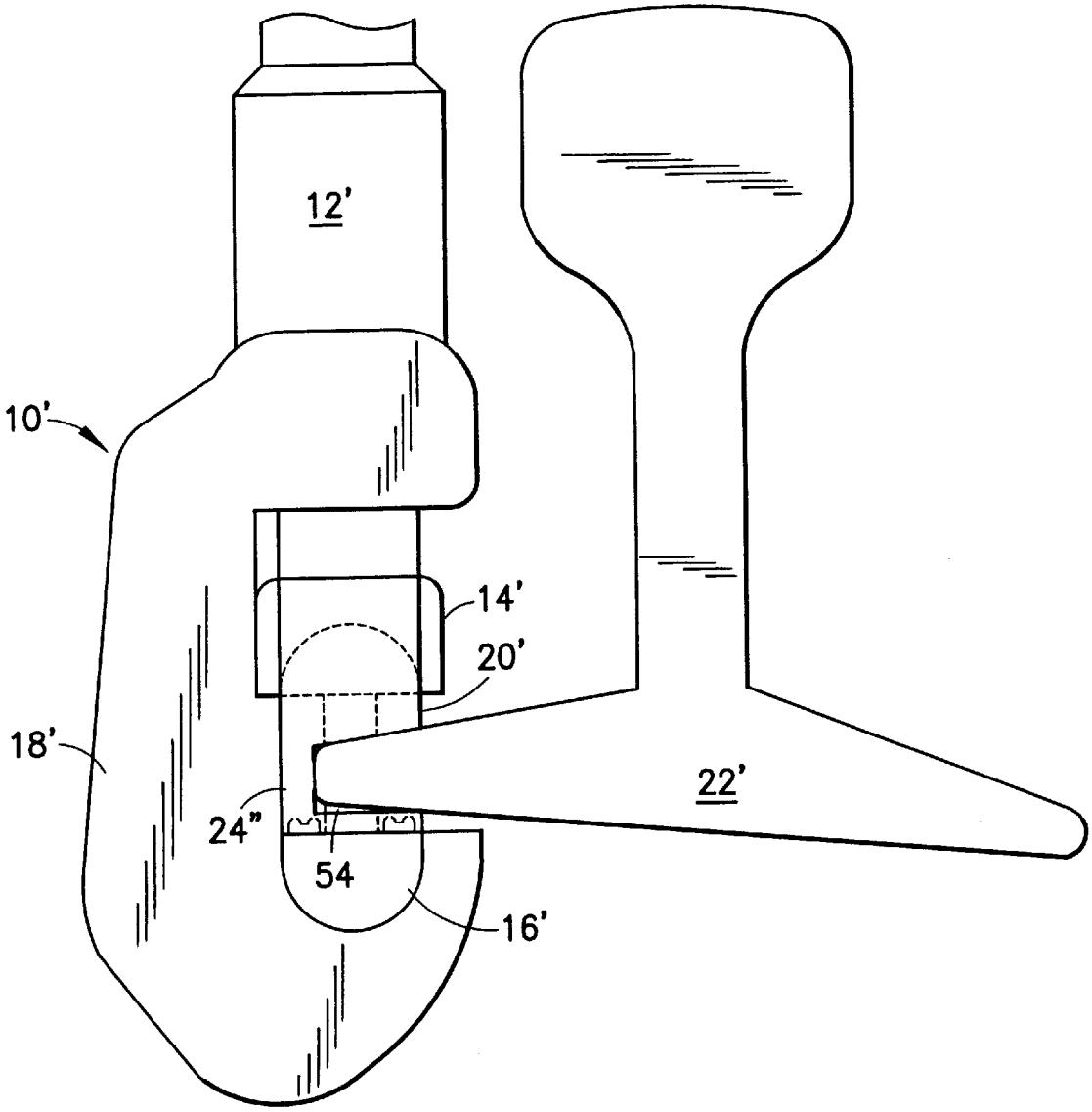
FIG. 10 is a partially fragmentary side elevation view showing a third embodiment of a guard on a crimping tool.

As seen in FIGS. 1 and 10, the tool 10,10' generally comprises a drive mechanism 12, a ram 14 which is driven by the drive mechanism 12 against an anvil head 16. The tool includes a frame 18 which connects the threads to the drive mechanism 12 to effect a uni-body construction of the device. The drive mechanism 12 is a standard hydraulic cylinder which is sold by Framatome Connectors International under part No. 750 series. Between the ram 14 and the anvil 16 is a space 20 into which the ram 14 is extended. A workpiece 22 is disposed within the space 20 and is maintained against the anvil 16 so that a work operation can be conducted on it by the movement of the ram 14.

In accordance with the invention, a guard 24, 24" (See FIGS. 1 and 10) is provided as part of the tool 10 so that the workpiece 22 is maintained against movement relative to the anvil 16. The guard 24 as illustrated occupies a substantial area of the space 20 between the fixed anvil 16 and the ram 14 so as to prevent a finger or part of the hand from being caught by the cleaving action of the ram or jaw 14 and thereby avoiding injury to the user.

Figure 2:
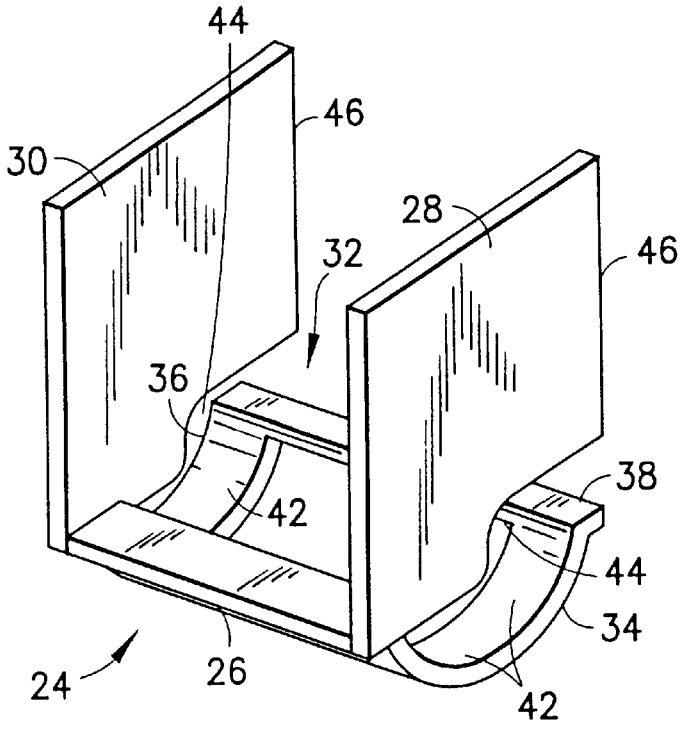
FIG. 2 is a perspective view of the guard shown apart from the compression tool in FIG. 1.

Referring now to FIG. 2, it should be seen that the guard 24 of this embodiment is comprised of a unitary piece of sheet metal which has a stamped configuration lending it to ease of manufacture and durability. The guard 24 is defined by a transverse portion 26 with integrally connected first and second side walls 28 and 30 which extend perpendicularly to the transverse portion 26 and extend parallel to one another thereby giving the guard a generally U-shaped configuration.

Figure 3:
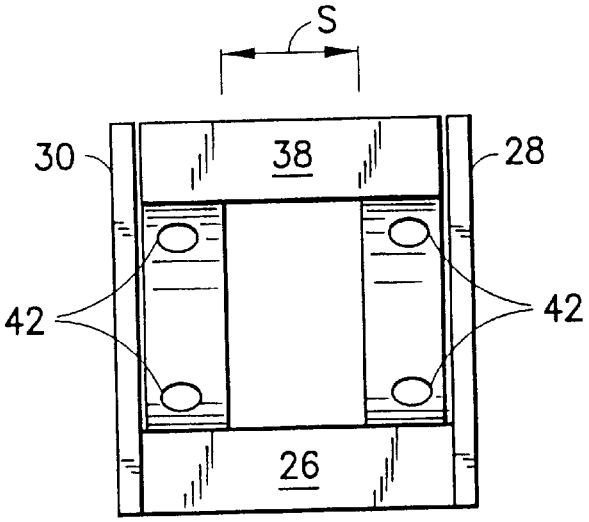
FIG. 3 is a top plan view of the guard shown in FIG. 2.
Figure 4:
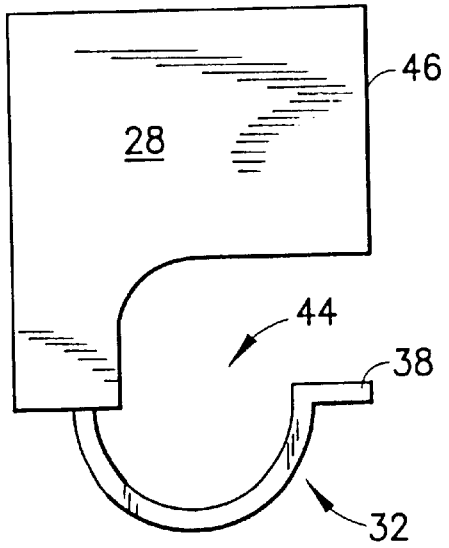
FIG. 4 is a side elevation view of guard shown in FIG. 3 apart from the compression tool.
Figure 5:
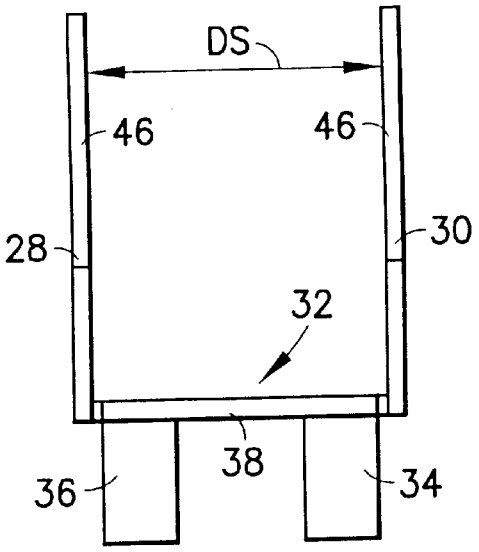
FIG. 5 is a front elevation view of the guard shown in FIG. 4.

As is best seen in FIGS. 4 and 5, the guard 24 further includes a cradle portion 32 which is defined by two parallel arcuately shaped parts 34, 36 depending from the transverse portion 26 at one end thereof and the opposite ends of the arcuate parts 34 and 36 each being connected with one another by a second transverse part 38 interconnecting the otherwise cantilevered arcuate parts 34 and 36 with one another at the opposite sides thereof. The arcuate parts 34 and 36 are thus spaced from one another by the dimension indicated as S in FIG. 3 which is sufficiently sized to permit a tool, in this case, the anvil portion 16 of the tool 1 to extend therebetween. Similarly, the sidewalls 28 and 30 are spaced from one another by a distance DS sufficient to straddle the width of the opposing die when it is moved towards the guard.

Figure 6:
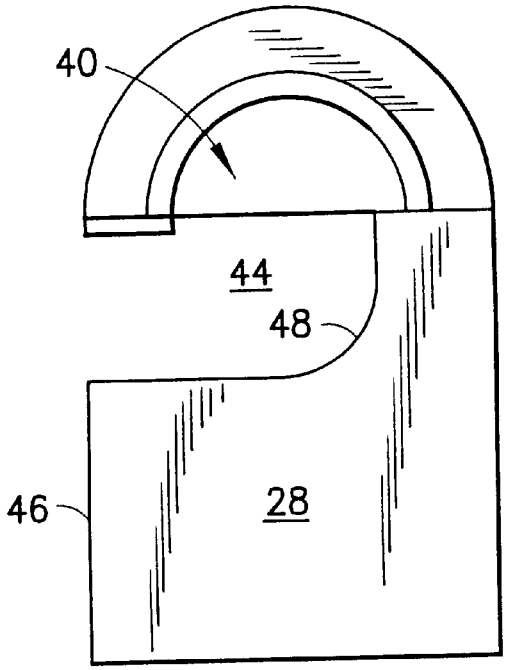
FIG. 6 is a side elevation view showing the guard connected the upper cutting die.
Figure 7:
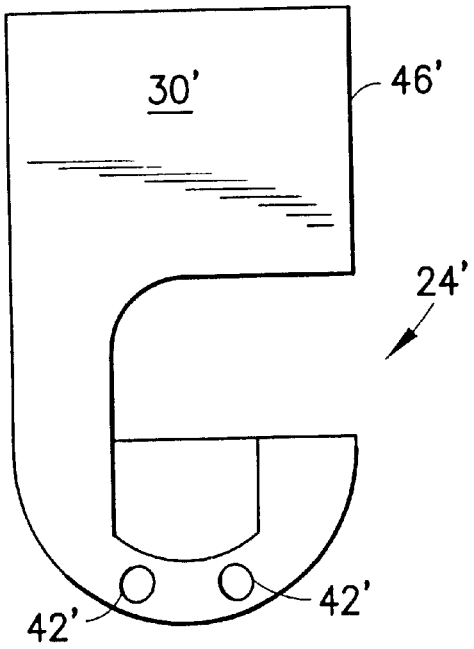
FIG. 7 is a view of a second embodiment of a guard shown in side elevation connected directly to a cutting die.
Figure 8:
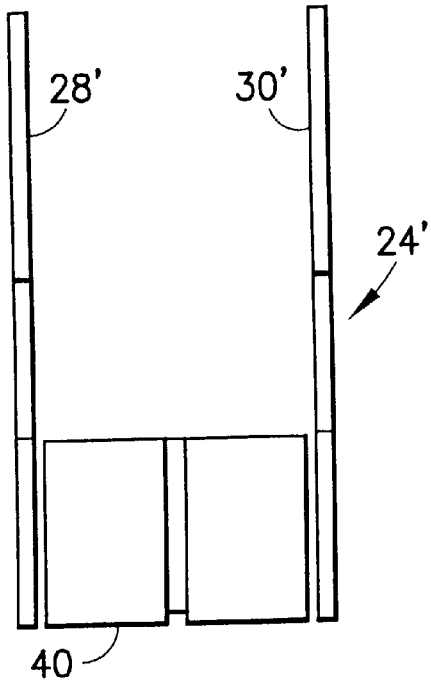
FIG. 8 is front elevation view of the guard shown in FIG. 7.
Figure 9C:
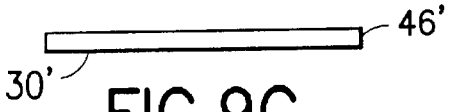
FIG. 9C is a top plan view of the guard plate shown in FIG. 9B.
Figure 9A:
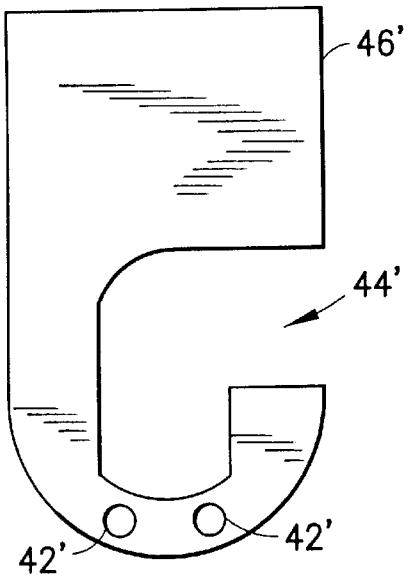
FIG. 9A is a side elevation view of a guard plate.
Figure 9B:
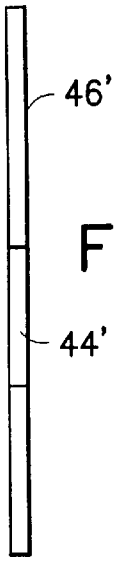
FIG. 9B is a front elevation view of the guard plate shown in FIG. 9A.
Figure 11:
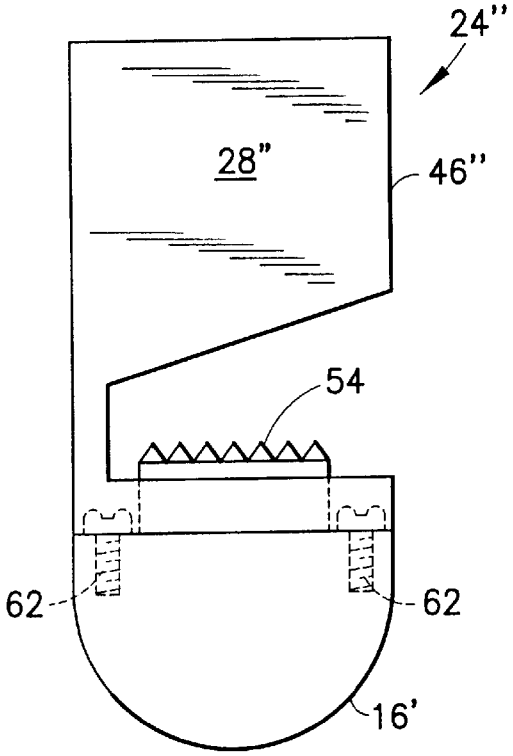
FIG. 11 illustrates a side elevation view of a third embodiment shown connected to a dimpling die.

In the particular embodiment of FIG. 1, the spacing S (shown in FIG. 3) between the arcuate parts 34 and 36 as best illustrated in FIG. 6 is sized to allow the arcuate parts 34 and 36 to straddle opposite sides of the stationary cutter die 40 which is mounted to the frame 18 as part of the anvil 16 of the tool 1. A plurality of openings 42, 42 are provided within each of the arcuate parts 34 and 36 and are located thereon in correspondence with threaded openings formed in the corresponding arcuate surfaces of the anvil 16 which are disposed on opposite sides of the cutting die 40.

Each side wall 28 and 30 has a workpiece receiving cut-out 44 formed in it which is correspondingly sized and shaped to receive the workpiece 22 therein. The workpiece 22 in the illustrated example of FIG. 1 is a grounding rod having a maximum diameter of approximately ¾ inch. The cut-out 44 extends inwardly from the leading edge 46 of the side walls 28 and 30 horizontally inwardly and at a point of curvature 48 turns a 90° upwardly so as to communicate and form a receiving area with the generally semi-circular form of the arcuate members 34 and 36. In this way, the workpiece 22 can be slid laterally inwardly into the cut-out 44 whereupon on meeting the curvature 48 is urged upwardly toward the cutting die 40 where it is maintained until such time that it is impacted by the ram 14. It should also be noted that the ram 14 carries a corresponding movable cutting die 50 (See FIG. 1) which cooperates with the cutting die 40 to effect, in this case, a cutting operation.

Referring now to FIGS. 7, 8, 9A, 9B and 9C, it should be seen that a second embodiment of the guard 24' is illustrated therein. The guard 24' in this case is comprised solely of the tool side walls 28' and 30' which are in the form of separate plate elements connected to the anvil 16 through the intermediary of connecting screws secured within openings 42', 42' aligned with corresponding threaded openings in the side of the anvil 16. Thus, the connecting screws clamp the side walls 28' and 30' in place in the illustrated manner of FIG. 1 to form a generally U-shaped member. It should be understood that the die 40 being fixed to the anvil 16 in the embodiments of FIG. 7, 8 and 9A, 9B and 9C functions as the transverse portion of a U-shaped guard illustrated in perspective view in FIG. 2.

Referring now to FIGS. 10, 11, 12, 13A, 13B and 13C, and to the third embodiment of the guard, it should be seen that the anvil 16' of the tool 1 shown in FIG. 10 carries a guard 24" which is adapted for use with a dimpling tool 10'. In the illustration of FIG. 10, the anvil 16' has a die 54 secured to it which is adapted to work the surface of a workpiece 22' such as the rail shown in FIG. 10.

Figure 12:
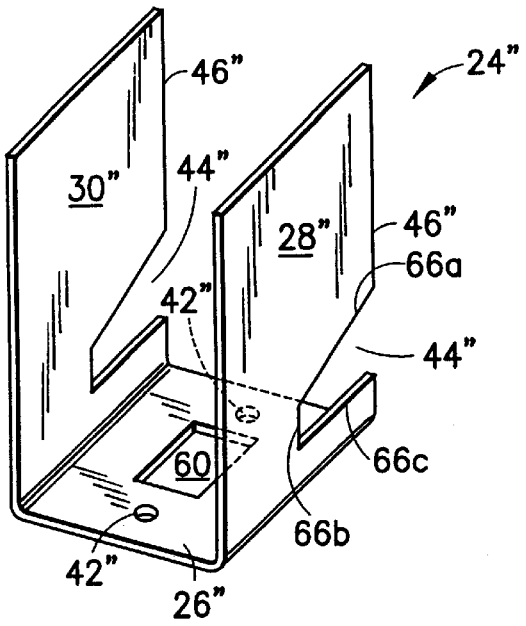
FIG. 12 is a perspective view of the guard shown in FIG 11.
Figure 13A:
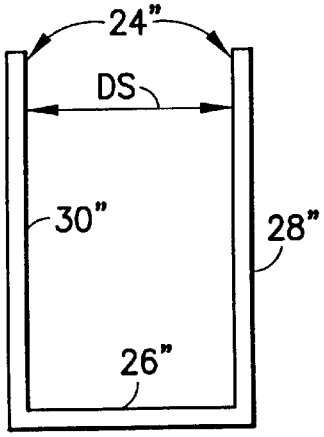
FIG. 13A is a rear elevation view of the guard shown in FIG. 12.
Figure 13B:
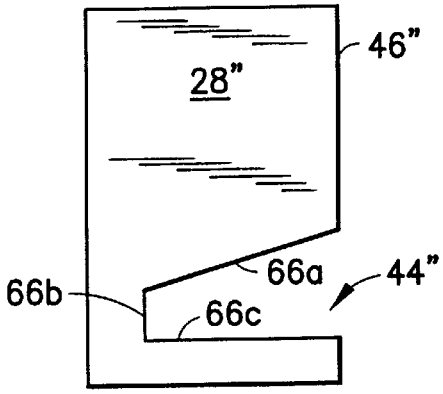
FIG. 13B is a side elevation view of the guard shown in FIG. 13A.
Figure 13C:
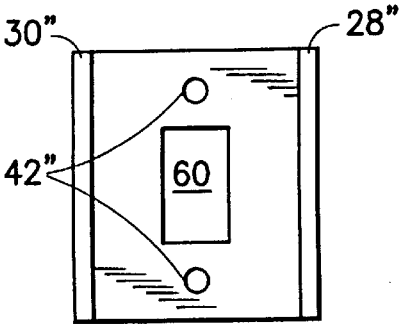
FIG. 13C is a bottom view of the guard shown in FIG. 13B.

As best illustrated in FIG. 12, the guard 24' is formed from a unitary piece of sheet metal which is stamped forming the generally U-shaped configuration of the present invention. In particular, as illustrated in FIG. 12, the guard 24' includes first and second side walls 28" and 30" which are integrally connected by a single transverse portion 26" which is secured at opposite ends thereof to the vertically extending side walls 28' and 30". The transverse portion 26" includes an opening 60 through which the dimpling die 54 protrudes. That is, the opening 60 is dimensioned so that the dimpling die 54 passes without interference through the opening so as to protrude upwardly from the transverse member 26". A plurality of openings 42", 42" are formed in the transverse member 26" and are sized to receive securement screws 62, 62 (see FIG. 11) which secure the guard 24" to the die.

The leading edges 46", 46" of each of the side walls has a cut-out 44" formed therein. Each cut-out 44" is defined by an angular side edge 66*a*, a vertical side edge 66*b* which extends perpendicularly to the transverse members 26" and a horizontally disposed side edge 66*c* which is disposed parallel to the transverse member 26". In the illustrated embodiment of FIG. 12, the angular side edge 66*a* measures approximately 14° to the horizontal for the case where the guard is being used in conjunction with a rail, but can vary for example, to 0° when the use is in conjunction with a wide flange, or can vary to 10° when the guard is used in conjunction with a standard flange.

Each of the side walls 28" and 30" is spaced by a distance DS (see FIG. 13*a*) sufficient to straddle the opposite die or anvil of the tool so as to receive it therebetween when it is moved toward the guard. In this way, the guard 24" closes the space 20' between the dies against inadvertent exposure of a limb or digit of a person's hand and/or a foreign object, to the clamping action of the ram.

Accordingly, the invention has been described by way of illustration rather than limitation. For example, while the invention has been described as connected to the anvil part of the tool, it is within the purview of the invention to have it connected to the moving ram part of the tool instead.

What is claimed is:

1. A hydraulic compression tool comprising:

a frame;

a movable die movably connected to the frame with a hydraulic drive system; and an alignment guard connected to the frame, and having a receiving area to receive a workpiece therein, wherein the workpiece can be received in the receiving area and make contact with the alignment guard such that the alignment guard aligns the workpiece relative to the path of a die for aligning contact of the die against the workpiece as the die is moved toward the workpiece wherein said alignment guard being defined by a generally U-shaped construction having lateral sidewalls each extending along a side of a working surface of the die, and a transverse portion, wherein each of said sidewalls has a leading edge extending parallel to the path of travel of the die and has a cutout formed therein with an opening in the leading edge, the cutouts communicating with said receiving area such that a workpiece can be inserted laterally into the cutouts through said openings in the leading edges of said sidewalls and slid in the cutouts laterally relative to the path of the die towards said receiving area.

2. A hydraulic compression tool as defined in claim 1 further characterized by the tool being comprised of a fixed die disposed oppositely of said movable die and the alignment guard is attached to one of said fixed die and movable die.

3. A hydraulic compression tool as defined in claim 2 further characterized by said alignment guard being defined by side walls connected to said fixed die.

4. A hydraulic compression tool as defined in claim 3 further characterized by said side walls being plate elements attached to lateral sides of said fixed die.

5. A hydraulic compression tool as defined in claim 2 further characterized by said alignment guard being defined by side walls connected to one of said fixed die and said movable die, said side walls defining said receiving area which is defined by an angled side edge connecting to a vertically extending side edge and an edge disposed perpendicularly thereto for receiving an angled flange therein.

6. A hydraulic compression tool comprising a frame, a movable die movably connected to the frame with a hydraulic driven system; an alignment guard connected to the frame, the alignment guard extending along a side of the die and having a receiving area to receive a workpiece therein, wherein the workpiece can be received in the receiving area and make contact with the alignment guard such that the alignment guard aligns the workpiece relative to the path of the die for aligning contact of the die against the workpiece as the die is moved toward the workpiece, a fixed die disposed oppositely of said movable die, the alignment guard being attached to one of said fixed die and movable die, wherein said alignment guard is a one piece stamping having a generally U-shaped form with lateral sidewalls and a transverse portion, and wherein said alignment guard is attached to one of said fixed die and said moving die through said transverse portion, said transverse portion including an opening through which a work surface of said one of said fixed die and said moving die extends.

7. A hydraulic compression tool comprising a frame, a movable die movably connected to the frame with a hydraulic drive system; an alignment guard defined by integrally formed sidewalls and a connecting transverse portion, each sidewall being disposed along a side of the die, and spanning a work surface of the die, the alignment guard having a receiving area to receive a workpiece therein, wherein the workpiece can be received in the receiving area and make contact with the alignment guard such that the alignment guard aligns the workpiece relative to the path of a die for aligning contact of the die against the workpiece as the die is moved toward the workpiece, a fixed die disposed oppositely of said movable die and the alignment guard is attached to one of said fixed die and movable die, and wherein said sidewalls each having a leading edge extending parallel to the path of travel of the die and the leading edges each having a cutout formed therein extending inwardly therefrom and communicating with said receiving area such that a workpiece can be slid laterally through said cutout relative to the leading edge of said guard and urged towards said receiving area.

8. A hydraulic compression tool as defined in claim 2 wherein said alignment guard is attached to one of said fixed die and said moving die through said transverse portion.

9. A guard adapted for working with a hand held compression tool having a die which moves relative to the tool along a given path acting on surface of a workpiece comprising:

a base defined by a substantially transversely extending member;

two parallel spaced sidewall members each extending generally perpendicularly to and secured to said base, said sidewall members being spaced a distance apart to accommodate the width of a tool therein;

said sidewall members including means for connecting same to said base and including a cutout sized to accommodate the profile of a workpiece to be worked on by said tool acting in a direction perpendicularly to the workpiece surface to be acted on, and wherein said guard is a one-piece sheet metal member formed in a general U-shape, and wherein said sidewall members each having a leading edge extending parallel to the path of travel of the die and the leading edges each having said cutout formed therein extending inwardly therefrom and communicating with said receiving area such that a workpiece can be slid laterally through said cutout relative to the leading edge of said guard and urged towards said receiving area.

10. A guard as defined in claim 9 further characterized by said sidewall members being formed from sheet metal.

11. A guard as defined in claim 10 further characterized by said base having a passage formed therein for permitting a tool to extend upwardly through said passage and beyond said base.

12. A guard as defined in claim 11 further characterized by each of said sidewalls at said side edges thereof having one end and another end to define the overall length thereof and said base being located closer to said one end than to said another end.

13. A guard as defined in claim 12 further characterized in that said cutout in each of said sidewalls is defined by an angled side edge connecting to a vertically extending side edge and an edge disposed perpendicularly thereto for receiving an angled flange therein.

14. A guard as defined in claim 13 further characterized by said sidewalls spaced apart sufficient by a distance to receive a tool therebetween.

15. A guard as defined in claim 9 further characterized by a pair of spaced arcuate parts extending from said base.

16. A hydraulic compression tool comprising:

a frame;

a movable die movably connected to the frame with a hydraulic drive system; and an alignment guard connected to the frame, the alignment guard extending along a side of the die and having a receiving area to receive a workpiece therein, wherein the workpiece can be received in the receiving area and make contact with the alignment guard such that the alignment guard aligns the workpiece relative to the path of a die for aligning contact of the die against the workpiece as the die is moved toward the workpiece and wherein said guard has at least one lateral sidewall having a leading edge extending in a direction parallel to the path of the die and said at least one lateral sidewall including a cutout extending inwardly from the leading edge thereof and has a locating surface directed toward said receiving area from said leading edge such that a workpiece can be slid laterally through said cutout relative to the leading edge of said guard and urged by said locating surface towards said receiving area.

17. A hydraulic compression tool as defined in claim 16 further characterized by said guard being formed from at least one plate attached to a lateral side of one of a fixed and a moving die.

18. A hydraulic compression tool as defined in claim 16 further characterized by said guard being defined by a generally U-shaped construction having lateral side walls and a transverse connecting portion.

19. A hydraulic compression tool as in claim 16, wherein the locating surface is curved so that the workpiece slid laterally in the cutout from the leading edge is urged by the locating surface in a direction parallel to the path of the die into the receiving area.

* * * * *